United States Patent [19]

Hemmerich

[11] 4,267,707

[45] May 19, 1981

[54] THERMAL RADIATION SHIELD

[75] Inventor: Johann Hemmerich, Jülich, Fed. Rep. of Germany

[73] Assignee: Kernforschungsanlage Jülich Gesellschaft mit beschränkter Haftung, Jülich, Fed. Rep. of Germany

[21] Appl. No.: 92,660

[22] Filed: Nov. 9, 1979

[30] Foreign Application Priority Data

Feb. 23, 1979 [DE] Fed. Rep. of Germany ..... 2907055

[51] Int. Cl.[3] ..... F28F 1/30

[52] U.S. Cl. ..... 62/514 R; 62/55.5; 428/596; 428/137; 428/603; 165/182

[58] Field of Search ..... 62/55.5, 514 R; 165/80 R, 80 E, 185, 182; 428/131, 134, 137, 596, 603; 29/157.3 R, 163.5 R

[56] References Cited

U.S. PATENT DOCUMENTS

| | | | |
|---|---|---|---|
| 2,899,178 | 8/1959 | Dubin et al. | 165/182 |
| 3,241,610 | 3/1966 | Kritzer | 165/182 |
| 3,252,652 | 5/1966 | Trendelburg et al. | 230/69 |
| 3,423,947 | 1/1969 | Moriya | 62/55.5 |
| 3,635,039 | 1/1972 | Power et al. | 62/55.5 |
| 3,746,087 | 7/1973 | Lavering et al. | 165/185 |

FOREIGN PATENT DOCUMENTS

| | | | |
|---|---|---|---|
| 1816981 | 8/1969 | Fed. Rep. of Germany . | |
| 1628431 | 11/1971 | Fed. Rep. of Germany . | |
| 2455712 | 8/1976 | Fed. Rep. of Germany . | |
| 283039 | of 1970 | U.S.S.R. | 62/55.5 |

*Primary Examiner*—Marion McCamish
*Assistant Examiner*—Alexander S. Thomas
*Attorney, Agent, or Firm*—Karl F. Ross

[57] ABSTRACT

A thermal radiation shield for cryogenic devices, especially cryogenic pumps (cryopumps) comprises a stack of spaced apart plates formed preferably with a V-section configuration and lugs or openings enabling the plates to be stacked with appropriate spacers upon tubes through which a coolant is passed. The plates have an annular configuration, i.e. the V-section is closed along an annulus. The plates are so stacked as to overlap in the stacking direction, i.e. the vertex of the V of one plate is coplanar with the rim of the next plate or the vertex lies within the V of the next plate.

9 Claims, 5 Drawing Figures

THERMAL RADIATION SHIELD

FIELD OF THE INVENTION

My present invention relates to a thermal radiation shield for cryogenic devices and especially for cryogenic pumps (hereinafter cryopumps) and, more particularly, to a radiation shield of the type which comprises a stack of angle members so disposed as to obstruct straight-line radiation to and from the cryogenic surface while permitting gas circulation through the shield.

BACKGROUND OF THE INVENTION

Radiation shields adapted to flank or surround cryogenic elements or surfaces, especially cryogenic members of machines such as cryopumps, have been provided heretofore in the form of angle strips which lie in a jalousie configuration so as to form an optically obstructing system whereby straight-line passage of radiation to or from the cryogenic surface is blocked by the strips.

Reference will be made to the concept of "optical obstruction" hereinafter and it should be understood that this is intended to mean that the spaced-apart strips are so oriented that they intercept straight-line radiation to or from the cryogenic surface, i.e. are so disposed that a lower edge of one strip lies below or is coplanar with the upper edge of the next underlying strip. To this extent, projections of the strips in a plane parallel to the radiation surface will overlap. It is this type of overlapping which is intended when overlapping is discussed below.

Radiation shields of this type thus include a multiplicity of spaced-apart but superimposed inclined strips of high thermal conductivity held together by a body which itself is cooled, i.e. filled with a cooling medium.

As has been noted, such heat shields are employed to minimize the heat influx to the cold surfaces of cryopumps and the like.

In general the sheet-metal strips are blackened, are disposed in the optical obstruction relationship mentioned previously, but nevertheless form a gas-permeable structure which is cooled by the liquid coolant, for example, liquid nitrogen.

In prior-art systems, these strips have been bent or angled metal strips with a V cross section whose apex angle was usually 120° and the strips were soldered onto the ducts or vessels containing the liquid nitrogen and forming side walls of the radiation shield.

Direct radiation to and from the cryogenic surface was thus blocked effectively by the array of strips flanking the surface while gas permeability, although reduced to about 25% by a properly designed strip array with minimum overlapping, was still quite satisfactory with respect to the savings in liquid helium consumption achieved by this device.

While these devices were found to be highly effective, they were expensive to fabricate and had to be custom-built for each cryogenic installation. Furthermore, once constructed, they could not be effectively altered to change their size or repair or replace the strips. Furthermore, the non-permeability of the sidewalls precludes effective operation of the cryogenic device, e.g. the cryopump, whose intake side frequently was partly obstructed by these side-walls.

OBJECTS OF THE INVENTION

It is the principal object of the present invention to provide an improved heat shield for the purposes described.

Another object of the invention is to provide a thermal radiation shield for cryopumps and like devices with improved gas permeability and reduced radiation losses, which can be fabricated economically and conveniently and simply and which will have a minimum effect upon the efficiency of the cryopump.

SUMMARY OF THE INVENTION

These objects and others which will become apparent hereinafter attain, in accordance with the present invention, in a radiation shield for the purposes described which comprises a stack of spaced-apart closed annular plates, i.e. angle plates which are toroidally closed, which are mounted with spacers upon cooled tubes, i.e. tubes traversed with a coolant or containing a coolant such as the liquid nitrogen mentioned previously and which are held in the stack by these tubes, the resulting assembly being free, therefore, from any sidewalls and having the tubes spaced apart around the stack.

According to a feature of the invention, the plates are each formed with eyes or like formations (advantageously at least three, as required to hold and retain a part in a fixed plane) having openings through which the pipes can be threaded or by which the eyes can be drawn over the pipes, thereby simplifying assembly of the stack with the pipes. The spacers of the present invention can, of course, be thermally conductive spacer sleeves.

The toroidal plates can have any plan configuration as long as the V-section portion extends in a closed annular pattern so that the plates can be round, rectangular or oval rings. In all of these cases, the plates are sufficiently stiff to resist bending and torsional stresses, such that precise assembly with minimum overlapping in order to achieve maximum gas permeability while still conserving optical density can be achieved. Since they can be made by stamping techniques with high precision and hence reduced finishing tolerances, the plates can be mass-produced and assembled with ease. The plates can also be fabricated in part by deep drawing or by a combination of deep drawing and stamping or deep drawing and punching. The intrinsic stiffness of the plates permits them to be stored, handled, assembled, etc. with ease and without damage. They can also be shipped long distance without difficulty.

Furthermore, the pipes or tubes which are filled with or conduct the coolant can have any desired cross-sectional configuration although it is preferred to operate with round-section, i.e. circular cross section, pipes through which a coolant is pumped. The sleeves themselves can have a length which is slightly less than the altitude of the V cross section of the plates and can also be provided, like the plates, as a standard element so that thermal radiation shields of practically any size can be readily assembled to the needs of the user from these standard elements.

Obviously since the gas-impermeable sidewalls are completely eliminated the obstruction to the gas flow is minimized, thus resulting in maximum achievable pumping speed for a pump of given outside dimensions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 4A:
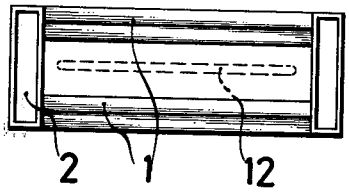
PRIOR ART FIG. 4a
FIG. 4*a* is a plan view of a prior art heat shield.
Figure 4B:
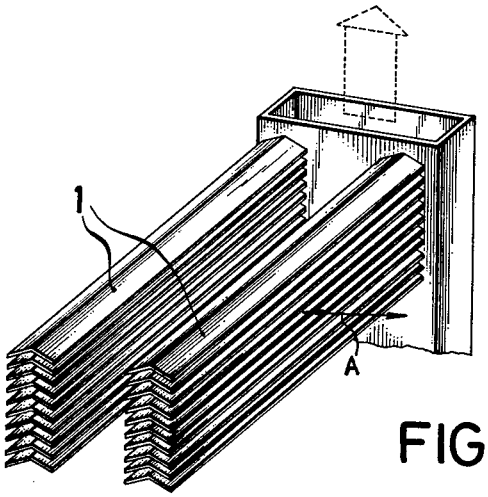
PRIOR ART FIG. 4b
FIG. 4*b* is a perspective view of the prior art heat shield with one of the sidewalls broken away.

Referring first to FIGS. 4*a* and 4*b* which illustrate a prior-art thermal radiation shield for cryogenic devices, e.g. a helium cooled surface 12 of a cryopump, it will be apparent that the shield consists of a pair of sidewalls 2 each of which is constituted by a hollow body which can be traversed by liquid nitrogen and between which the shield plates or strips 1 are soldered.

The strips themselves are comparatively unstable in a mechanical sense and may be deformed during assembly of the pump, in handling or the like, while the sidewalls 2 obstruct mass flow at least at the ends of the heat shield. The inverted-V shape of the strips, however, prevent straight-line radiation in the direction of the arrow A because of the overlap previously mentioned, i.e. the vertex of a lower strip may lie within the V of an upper strip.

Because of the impermeable nature of the sidewalls, i.e. the fact that gas cannot flow into the surrounded space through these sidewalls, the pump efficiency is adversely affected.

Figure 1:
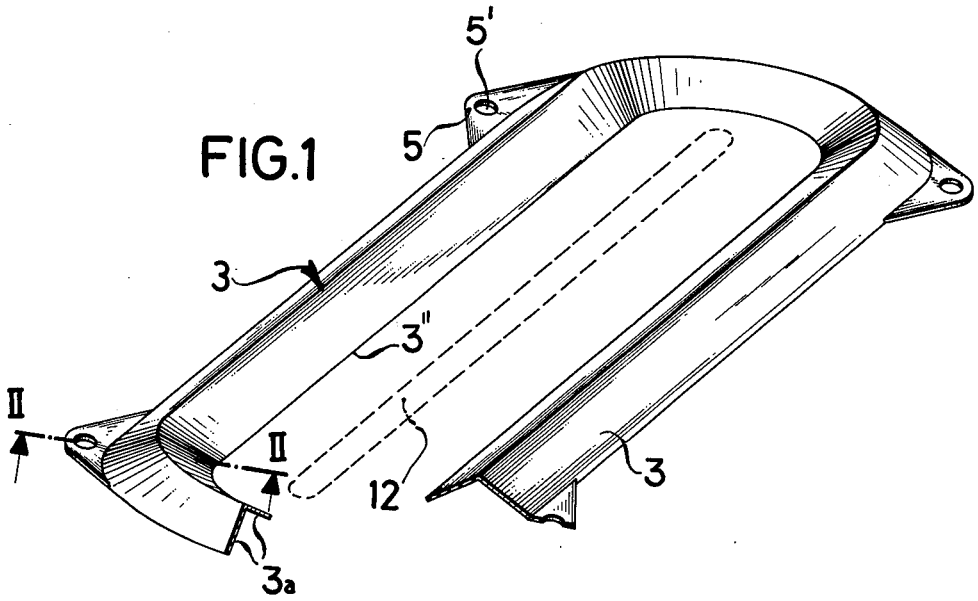
FIG. 1 is a perspective view, partly broken away, of a toroidal angle plate used in the heat shield of the present invention.
Figure 2:
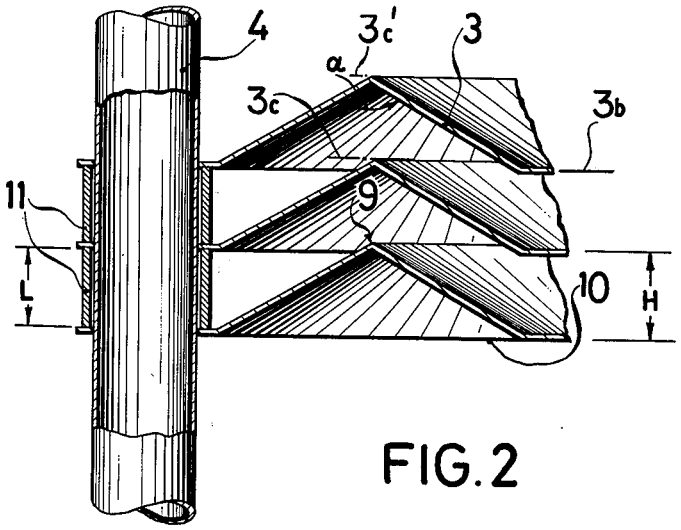
FIG. 2 is an enlarged partial section through a heat shield of the invention, the section line corresponding to that shown in II—II of FIG. 1.

In the system of the present invention, represented, for example in FIGS. 1 and 2, each of the plates (see FIG. 1) 3 is a generally toroidal configuration with the V configuration 3' extending in a closed annulus or ring around the central space 3" which encloses the He cold surface 12.

More specifically, the drawn or stamped plate 3 has a pair of flanks 3*a* diverging in the configuration of an inverted-V with an angle a of about 120° and forming a vertex 9.

According to the invention the plate 3 is provided unitarily with a plurality of laterally extending formations 5 here shown to be of triangular configuration and to be provided with circular holes 5' by forming eyes which can be threaded over circular cylindrical pipes 4 (FIG. 2) which are traversed by the liquid coolant e.g. liquefied nitrogen.

In place of, or in addition to, the eyes 5, 5', other openings or formations can be provided to enable the plates to receive the pipes 4 or pipes similar thereto. For example, webs 6 and 7 can be provided within the bights at the opposite ends of the oval plate 103 and can have circular holes 6' and 7' through which the respective pipes may be passed in addition or as an alternative, circular holes 8 or elliptical holes 8' can be provided in the V-section portion of the plate for threading over a circular-section pipe or an elliptical-section pipe. All of the pipes will generally be traversed by the liquid coolant.

The number of cooled connecting or mounting pipes (of round or other appropriate cross section) will depend upon the desired mechanical stability and size of the radiation shield and upon the cooling effectiveness desired, bearing in mind that the fewer pipes which are required, the greater will be the gas permeability of the radiation shield.

As can be seen from FIG. 2, the necessary spacing of the plates 3 or 103 from one another is effected by providing spacer sleeves 11 which thus alternate with the eyes or other formation through which the plates are threaded. The spacers 11 have lengths L which are slightly less than the altitudes H of the plates 3. The lower edges of the plates 3 form planes 3*b* perpendicular to the pipes 4 and the optical obstruction characteristic is obtained by providing that each vertex or ridge 9 lies above the lower edge 10, i.e. the plane 3*c* of this ridge lies within the space between the plane 3*b* and the plane 3*c* of the next higher plate.

While the spacers 11 are here shown as separate from the plates, they of course may be constituted by sockets formed unitarily or directly thereon, having abutments for a correct shield assembly, wherein the successive sockets engaging one another form the cooled connecting pipes.

The plates may also be provided with abutments elsewhere to ensure the desired spacing and/or may engage abutments or formations provided directly on the pipes.

Figure 3:
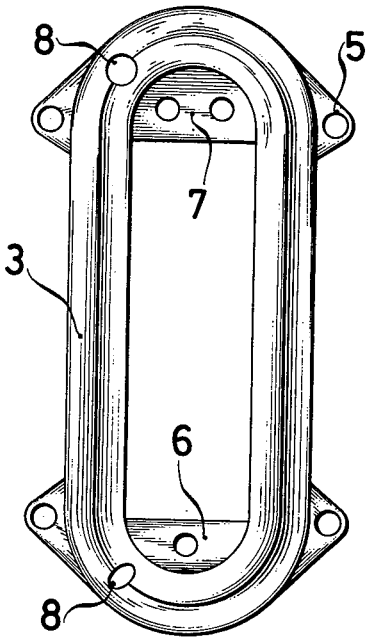
FIG. 3 is a plan view showing another toroidal plate in accordance with the principles of the invention.

FIGS. 1 and 3 show the preferred oval or elongated configuration of the plates which is particularly suitable for helium cold surfaces 12 of elongated cross section and is represented in FIG. 1 by broken lines. However, depending upon the cold surface to be shielded, they can have circular, rectangular or square configurations by way of example.

The shield of the invention can be fabricated relatively simply by simply providing pipes of the length corresponding to the size of the pump whereupon the plates and sleeves can be alternatively threaded onto the pipes and the entire assembly, is desired, soldered together in a conventional soldering furnace.

The result is a low-cost precision-made structurally stable radiation shield which does not detrimentally affect the operation of a cryopump and which can have a smaller size and mass than earlier systems. The plate thickness and shape, the cross section, number of pipes and spacings, the number of holes and like parameters can be modified and will without detrimentally affecting the stability and ability to assemble the units in an economical manner. The surface of the plates can be blackened as previously described.

I claim:

1. The combination of a cooled member of a cryogenic element with a thermal radiation shield, said shield comprising a plurality of spaced-apart stacked thermally conductive plates of annular configuration surrounding said member and having a continuous V-section extending in a toroidal pattern with a ridge of each plate extending into the V section of an overlying plate, said plates having aligned holes traversed by cooled tubes, and means for spacing said plates apart along said tubes.

2. The combination defined in claim 1 wherein said plates are formed with laterally extending eyes formed with said holes and threaded over the respective tubes.

3. The combination defined in claim 1 wherein said spacer means includes spacer sleeves threaded onto said tubes and interposed between the eyes of successive plates along each tube.

4. The combination defined in claim 3 wherein said plates have a generally oval form and four spaced-apart eyes.

5. The combination defined in claim 1, claim 2, claim 3 or claim 4 wherein each of said plates is provided with a pair of webs lying inwardly of the V section and provided with openings through which cooling tubes can be passed.

6. A thermal radiation shield for a cryogenic element which comprises a plurality of spaced-apart stacked thermally conductive plates of annular configuration surrounding said element and having a continuous V-section extending in a toroidal pattern with a ridge of each plate extending into the V-section of an overlying plate, said plates having aligned holes traversed by cooled tubes; and means for spacing said plates apart along said tubes, said plates being formed with laterally extending eyes formed with said holes and threaded over the respective tubes.

7. A thermal radiation shield for a cryogenic element which comprises a plurality of spaced-apart stacked thermally conductive plates of annular configuration surrounding said element and having a continuous V-section extending in a toroidal pattern with a ridge of each plate extending into the V-section of an overlying plate, said plates having aligned holes traversed by cooled tubes; and means for spacing said plates apart along said tubes, said spacer means including spacer sleeves threaded onto said tubes and interposed between the eyes of successive plates along each tube.

8. The shield defined in claim 7 wherein said plates have a generally oval form and four spaced-apart eyes.

9. A thermal radiation shield for a cryogenic element which comprises a plurality of spaced-apart stacked thermally conductive plates of annular configuration surrounding said element and having a continuous V-section extending in a toroidal pattern with a ridge of each plate extending into the V-section of an overlying plate, said plates having aligned holes traversed by cooled tubes; and means for spacing said plates apart along said tubes, each of said plates being provided with a pair of webs lying inwardly of the V-section and provided with openings through which cooling tubes can be passed.

* * * * *